US009688071B2

(12) United States Patent
Saito

(10) Patent No.: US 9,688,071 B2
(45) Date of Patent: Jun. 27, 2017

(54) HEAD ARRAY AND IMAGE FORMING APPARATUS INCORPORATING SAME

(71) Applicant: Akira Saito, Kanagawa (JP)

(72) Inventor: Akira Saito, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/175,112

(22) Filed: Jun. 7, 2016

(65) Prior Publication Data

US 2016/0361924 A1 Dec. 15, 2016

(30) Foreign Application Priority Data

Jun. 11, 2015 (JP) ..... 2015-118742
Feb. 26, 2016 (JP) ..... 2016-035081

(51) Int. Cl.
*B41J 2/155* (2006.01)
*B41J 25/00* (2006.01)
*B41J 2/145* (2006.01)

(52) U.S. Cl.
CPC ..... *B41J 2/155* (2013.01); *B41J 2/145* (2013.01); *B41J 2025/008* (2013.01); *B41J 2202/20* (2013.01)

(58) Field of Classification Search
CPC ..... B41J 2/145; B41J 2/155; B41J 1/16; B41J 25/3088; B41J 25/308; B41J 29/02; B41J 2025/008
See application file for complete search history.

(56) References Cited

U.S. PATENT DOCUMENTS

2009/0174750 A1 7/2009 Saito
2009/0225130 A1 9/2009 Saito
2011/0128323 A1 6/2011 Saito
2011/0187793 A1* 8/2011 Ishii ..... B21D 53/76 347/40
2011/0216128 A1 9/2011 Saito

FOREIGN PATENT DOCUMENTS

JP 2007-223196 9/2007
JP 2012-071473 4/2012
JP 2014-014972 1/2014

* cited by examiner

*Primary Examiner* — Geoffrey Mruk
(74) *Attorney, Agent, or Firm* — Cooper & Dunham LLP

(57) ABSTRACT

A line head array includes an array base, a bendable thin sheet-shaped plate, and a plurality of heads. The array base has a plurality of inclined surfaces. The bendable thin sheet-shaped plate has a bend and is positioned and mounted on the array base in a bent state. The heads are alternately arranged in a staggered manner on and secured to both sides of the bend of the sheet-shaped plate.

10 Claims, 5 Drawing Sheets

HEAD ARRAY AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2015-118742, filed on Jun. 11, 2015, and 2016-035081, filed on Feb. 26, 2016, in the Japan Patent Office, the entire disclosure of which is hereby incorporated by reference herein.

BACKGROUND

Technical Field

Aspects of the present disclosure relate to a line head array and an image forming apparatus incorporating the line head array to discharge liquid to a recording medium to form an image on the recording medium.

Related Art

An image forming apparatus that forms an image by discharging liquid, e.g., ink to a conveyed recording medium using a line head array in which a plurality of heads is arranged in a staggered manner, and the respective heads that constitute the line head array are adjusted to be in target positions accurately in a micron order and are secured thereto so as not to generate any faulty such as a streak in the image. It is known that an optical alignment method, in which a position of a nozzle, an alignment mark or the like is measured by a camera so as to be adjusted, has been adopted as a typical position adjusting method.

SUMMARY

In an aspect of the present disclosure, there is provided a line head array that includes an array base, a bendable thin sheet-shaped plate, and a plurality of heads. The array base has a plurality of inclined surfaces. The bendable thin sheet-shaped plate has a bend and is positioned and mounted on the array base in a bent state. The heads are alternately arranged in a staggered manner on and secured to both sides of the bend of the sheet-shaped plate.

In another aspect of the present disclosure, there is provided an image forming apparatus that includes the line head array to discharge liquid onto a conveyed recording medium to form an image on the recording medium.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1A:
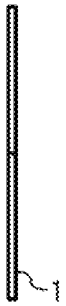
FIG. 1A is a left side view of a bendable thin sheet-shaped plate according to Embodiment 1 of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

In an image forming apparatus having a line head array, when a drum conveys a recording medium on which an image is to be formed, distances and angles between nozzle faces of a plurality of heads and the recording medium are adjusted so that the axial centers of nozzles are directed to the rotation center of the drum, in order to form the image favorably using the line head array including the plurality of heads arranged in a staggered manner. Therefore, the heads are secured to an array base that has a plurality of different inclined surfaces corresponding to the respective rows of the heads arranged in the staggered manner, so that the heads are radially arranged to the center of the drum.

However, since the positional adjustment of the heads by the optical alignment is carried out by measuring their positions on the same plane, the positions of the heads, which are arranged on the above-described different inclined surfaces, are not measured at the same time for adjustment and securing. Even if it is possible to measure and adjust the positions of the heads and secure the heads per row by the optical alignment, positional variations of the heads may occur between the head rows, thus hampering highly accurate construction of the line head array.

As described below, a line head array according to embodiments of the present disclosure includes a plurality of heads arranged in a staggered manner and is used to form an image onto a recording medium that is conveyed by a drum. The line head array also has following characteristics. For example, in the line head array, the plurality of heads is adjusted to be positioned in staggered arrangement and secured to a bendable thin sheet-shaped plate, and the sheet-shaped plate is bent so as to be secured onto different inclined surfaces of an array base. That is, after measuring and adjusting the positions of the plurality of heads and securing the plurality of heads, which is arranged in the staggered manner on the bendable thin sheet-shaped plate that is in a flat state, by an optical alignment method, the heads are secured onto the array base that has the different inclined surfaces.

Embodiment 1

Figure 1B:
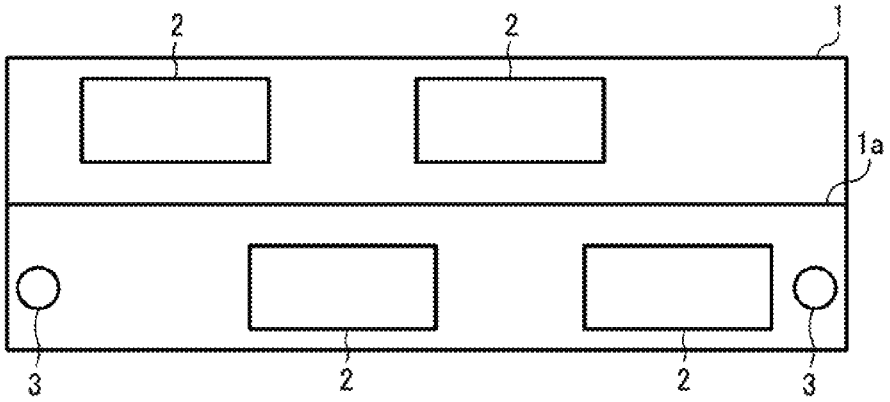
FIG. 1B is a front view of the sheet-shaped plate of FIG. 8A.

Features of the present disclosure will be described in detail with reference to following drawings. FIGS. 1A and 1B illustrate a bendable thin sheet-shaped plate 1 according to Embodiment 1 of the present disclosure. In the illustrated thin sheet-shaped plate (hereinafter, called simply as a sheet-shaped plate), a plurality of head mount openings 2 to mount a plurality of heads in a staggered manner and positioning reference holes 3 to position the sheet-shaped plate 1 on an array base are provided. The positioning reference holes 3 are provided on only one side of the sheet-shaped plate 1 with respect to a bend 1*a* at a center of the sheet-shaped plate 1. Incidentally, the positioning reference holes 3 are simply referred to as the reference holes 3 below.

Figure 2A:
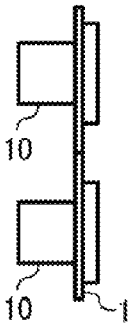
FIG. 2A is a left side view of a state in which heads are mounted on the sheet-shaped plate of FIGS. 1A and 1B.
Figure 2B:
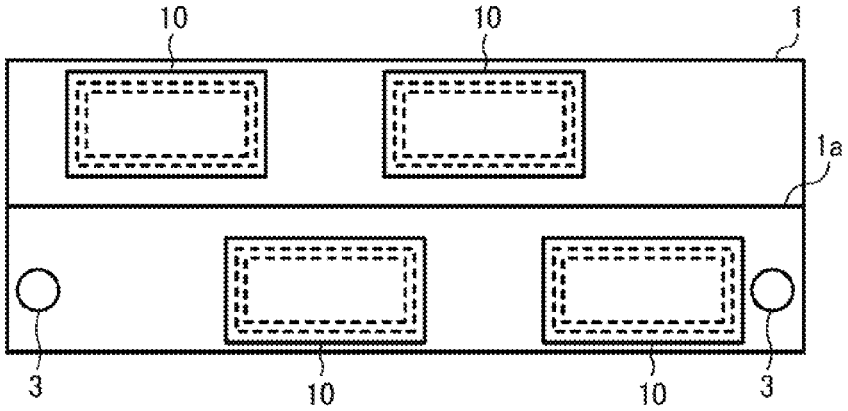
FIG. 2B is a front view of the state in which the heads are mounted on the sheet-shaped plate of FIGS. 1A and 1B.

FIG. 2A is a left side view of a state where heads 10 are mounted on the sheet-shaped plate 1 that is illustrated in FIGS. 1A and 1B, and FIG. 2B is a front view thereof. Positions of the plurality of heads 10 arranged in the staggered manner are adjusted with respect to target positions in a micron order, based on the reference holes 3 to position the sheet-shaped plate 1 on the array base in the state where the sheet-shaped plate 1 is planar, and the plurality of heads 10 is secured to the sheet-shaped plate 1. Since nozzle faces of the heads 10 arranged in the staggered manner are on the same plane, the positions of the heads 10 are adjusted accurately by an optical alignment method.

Figure 3:
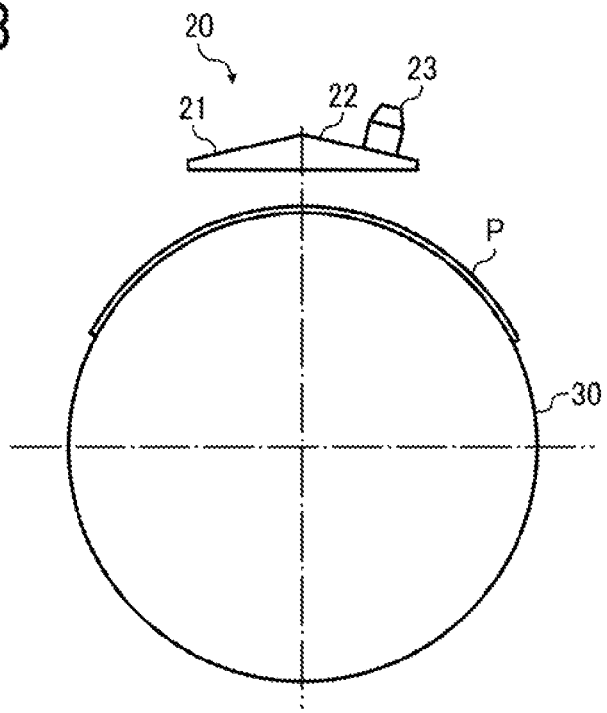
FIG. 3 is a cross-sectional view of an array base having different inclined surfaces, a drum, and a recording medium.

FIG. 3 is a cross-sectional view of an array base 20 having different inclined surfaces 21 and 22, a drum 30, and a recording medium P. A top end of the recording medium P is secured onto a circumferential face of the drum 30 by a clamper of the drum 30 and the recording medium P is conveyed by suction or the like in a state of being stuck to the drum 30, while an image is formed by a line head array in which the plurality of heads 10 is arranged in the staggered manner (which will be explained below with reference to FIG. 4). In order to form a favorable image, appropriate distances (gaps) are set between the nozzle faces of the respective heads 10 and the recording medium P, and nozzle shaft centers are set to have angles so as to direct to a center of the drum 30. This is to discharge liquid, e.g., ink onto the recording medium P at a right angle, and thus, the array base 20 has different inclined surfaces 21 and 22 formed thereon so that the heads 10 may be arranged radially to the center of the drum 30.

Further, the array base 20 includes: a reference pin 23 to position the sheet-shaped plate 1, on which the heads 10 in FIGS. 2A and 2B are mounted; and an opening provided so as not to be overlapped with the mounted heads 10.

Figure 4:
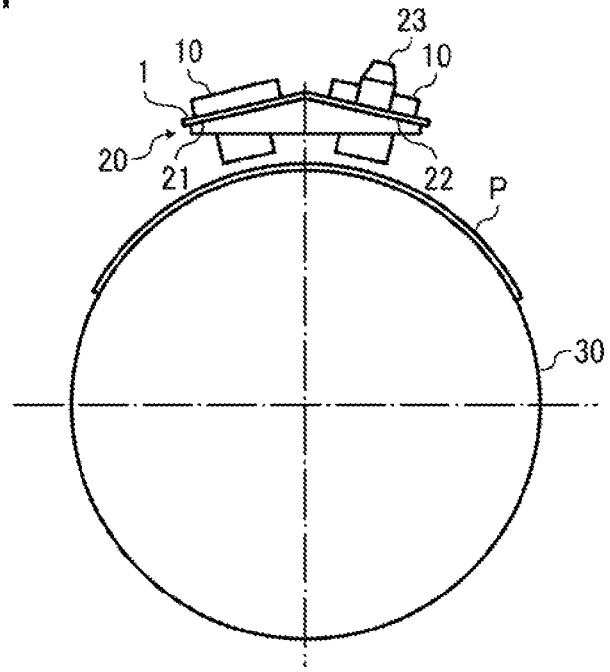
FIG. 4 is a cross-sectional view of a state in which the sheet-shaped plate of FIGS. 2A and 2B mounting the heads are secured to the array base of FIG. 3.

FIG. 4 is a cross-sectional view of a state in which the sheet-shaped plate 1 of FIGS. 2A and 2B, on which the heads 10 are mounted, is secured to the array base 20 of FIG. 3. While mounting the heads 10, the nozzle faces of the heads 10 that are arranged in the staggered manner, when the sheet-shaped plate 1 is in a planar state, are on the same plane, so that the sheet-shaped plate 1 can be positioned by optical adjustment so as to be secured. However, since the array base 20 has the different inclined surfaces 21 and 22, the sheet-shaped plate 1 is bent along the respective inclined surfaces 21 and 22 to be stuck and secured thereto. Further, the reference pin 23 provided on the array base 20 and the reference hole 3 of the sheet-shaped plate 1 are fit with each other, whereby the position of the sheet-shaped plate with respect to the array base 20 is determined at the same time. Thereby, the heads 10 arranged in the staggered manner are to be arranged radially so that the nozzle shaft centers in each row may be directed to the rotation center of the drum 30. Thus, a favorable image can be formed onto the recording medium P with a curvature which is obtained while being conveyed by the drum 30.

Embodiment 2

Figure 5A:
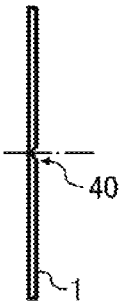
FIG. 5A is a left side view of a sheet-shaped plate according to Embodiment 2 of the present disclosure, in which a recessed groove is provided between rows of heads in staggered arrangement.
Figure 5B:
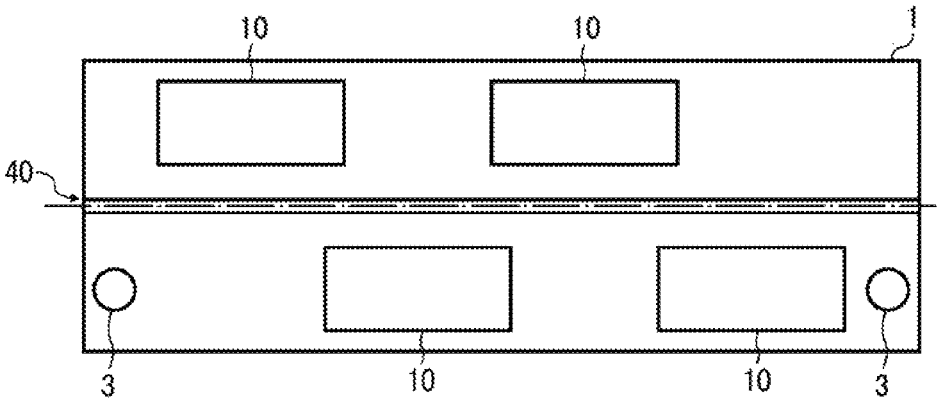
FIG. 5B is a front view of the sheet-shaped plate of FIG. 5A.

FIG. 5A is a left side view of a sheet-shaped plate 1 according to Embodiment 2 of the present disclosure, in which a recessed groove 40 is provided between rows of heads in staggered arrangement, and FIG. 5B is a front view thereof. In FIG. 5B, the recessed groove 40 is provided in a whole width direction of the sheet-shaped plate 1 between the rows of the heads 10 in the staggered arrangement on the bendable thin sheet-shaped plate 1. Due to the presence of this groove 40, the sheet-shaped plate 1 can be bent easily, and can be reliably stuck and secured to different inclined surfaces 21 and 22 of an array base 20 illustrated in FIG. 4. Thereby, a line head array with high positional accuracy can be constructed.

Embodiment 3

Figure 6A:
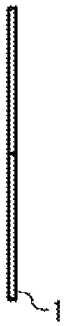
FIG. 6A is a left side view of a sheet-shaped plate according to Embodiment 3 of the present disclosure, in which a plurality of openings is provided between rows of heads in staggered arrangement.
Figure 6B:
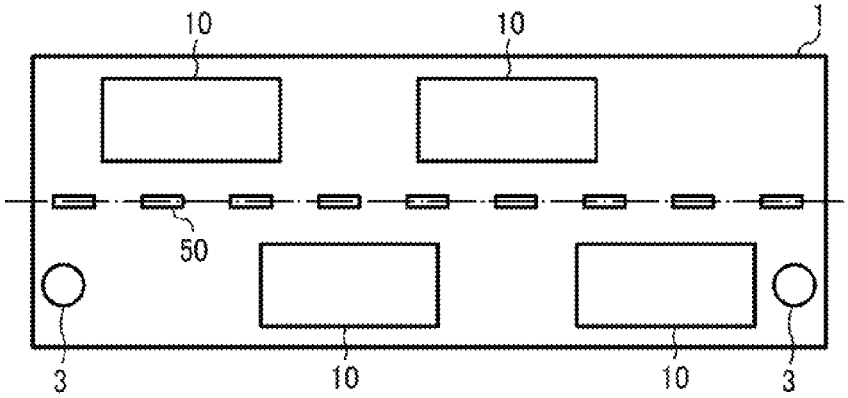
FIG. 6B is a front view of the sheet-shaped plate of FIG. 6A.

FIG. 6A is a left side view of a sheet-shaped plate 1 according to Embodiment 3 of the present disclosure, in which a plurality of openings 50 is provided between rows of heads in staggered arrangement, and FIG. 6B is a front view thereof. In FIG. 6B, the plurality of small openings 50 is provided in one row at an interval between the rows of the heads 10 in the staggered arrangement on the bendable thin sheet-shaped plate 1. Thus, the sheet-shaped plate 1 can be bent easily between the rows of the heads 10. Then, the sheet-shaped plate 1 can be reliably stuck and secured to different inclined surfaces 21 and 22 of an array base 20 while being in the state of FIG. 4, whereby a line head array with high positional accuracy can be constructed.

Embodiment 4

Figure 7:
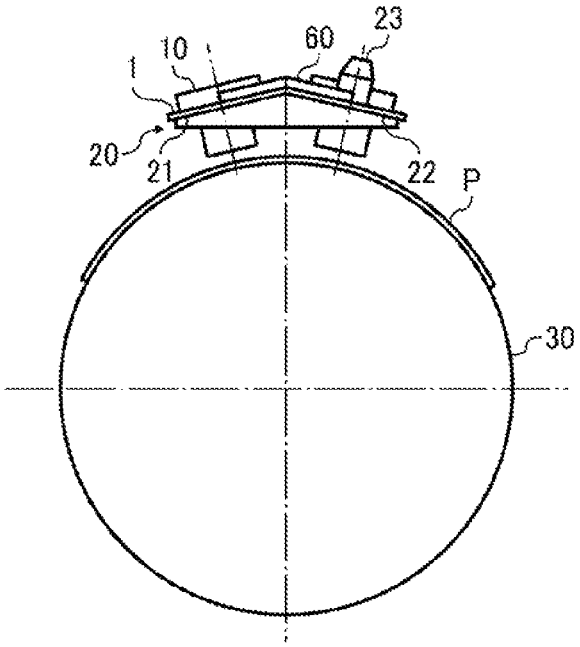
FIG. 7 is a cross-sectional view of an example of a configuration according to Embodiment 4 of the present disclosure, in which a retainer is used to bend a sheet-shaped plate so as to secure the sheet-shaped plate to an array base.

FIG. 7 is a cross-sectional view of an example in which a retainer 60 is used to bend a sheet-shaped plate 1 to secure the sheet-shaped plate 1 onto an array base 20. In the figures, the retainer 60 is formed to have a shape folded at an angle so that the retainer 60 may be parallel respectively to different inclined surfaces 21 and 22 of the array base 20. Then, the retainer 60 and the different inclined surfaces 21 and 22 of the array base 20 sandwich and bend the sheet-shaped plate 1 to press and secure the sheet-shaped plate 1 therebetween. Thus, the sheet-shaped plate 1 can be reliably and accurately stuck and secured to the different inclined surfaces 21 and 22 of the array base 20, without causing any failure including a rise of the sheet-shaped plate 1. Accordingly, even a line head array arranged radially to a drum 30 can be constructed with high accuracy.

Further, since a main scanning direction and an inclination of a recording medium P to be conveyed and a position thereof can be determined accurately, and the sheet-shaped plate 1 can be bent easily between head rows, the bendable thin sheet-shaped plate 1 can be stuck and secured accurately to the respective different inclined surfaces 21 and 22. Then, position measurement, adjustment and securing of heads 10, which are arranged in a staggered manner by optical adjustment in a state of securing the sheet-shaped plate 1 to a planar table in a facility to perform head mounting (where the sheet-shaped plate 1 is in a planar state), are completed. Thereafter, the thin sheet-shaped plate 1, on which the heads 10 are mounted, can be bent along the different inclined surfaces 21 and 22, and can be stuck and secured thereto. That is, for example, a thin stainless sheet-shaped plate has higher strength in a direction that is perpendicular to a plate thickness direction, and can be bent without changing positions of the heads 10 that are mounted in the planar state by the optical adjustment.

Embodiment 5

Figure 8A:
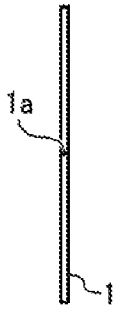
FIG. 8A is a left side view of a bendable thin sheet-shaped plate according to Embodiment 5 of the present disclosure.
Figure 8B:
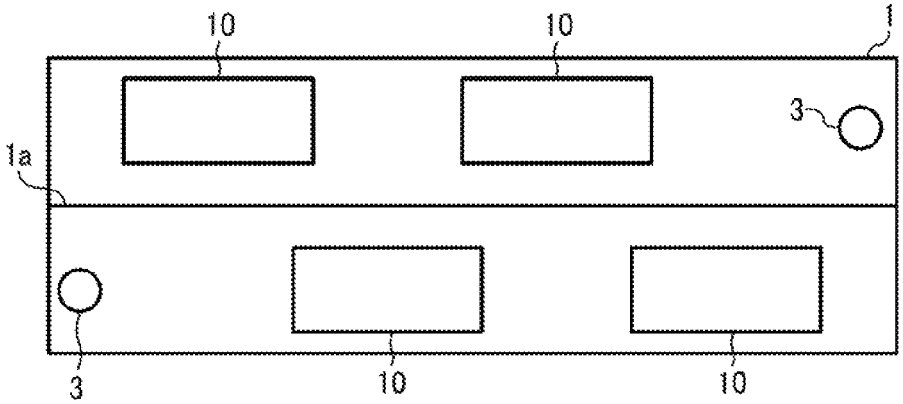
FIG. 8B is a front view of the sheet-shaped plate of FIG. 8A.

FIGS. 8A and 8B are views of Embodiment 5, which correspond to FIGS. 1A and 1B, respectively. In Embodiment 1, the reference holes 3 are provided on only one side of the sheet-shaped plate 1 with respect to the bend 1*a* of the sheet-shaped plate 1 along a longer end of the sheet-shaped plate 1, but the positions of the reference holes 3 are not necessarily limited to those, and they may be provided to be arranged on both sides of the bend 1*a* diagonally to the sheet-shaped plate 1 as illustrated in FIGS. 8A and 8B.

Embodiment 6

Figure 9A:
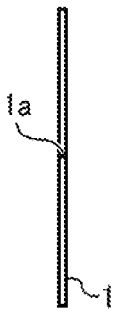
FIG. 9A is a left side view of a bendable thin sheet-shaped plate according to Embodiment 6 of the present disclosure.
Figure 9B:
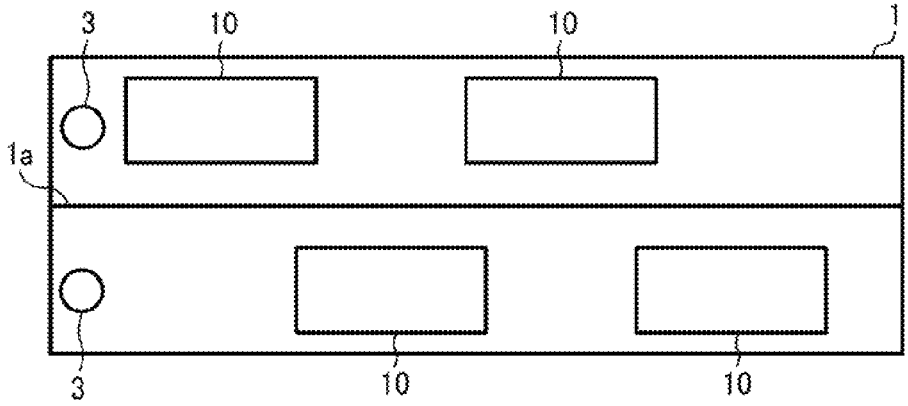
FIG. 9B is a front view of the sheet-shaped plate of FIG. 9A.

FIGS. 9A and 9B are views of Embodiment 6, which correspond to FIGS. 1A and 1B, respectively. In Embodiment 1, the reference holes 3 are provided on only one side of the sheet-shaped plate 1 with respect to the bend 1*a* of the sheet-shaped plate 1 along a longer end of the sheet-shaped plate 1, but the positions of the reference holes 3 are not necessarily limited to those, and they may be provided to be arranged on both sides of the bend 1*a* line-symmetrically along a shorter end of the sheet-shaped plate 1 as illustrated in FIGS. 9A and 9B.

Embodiment 7

Figure 10A:
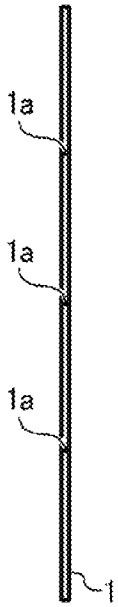
FIG. 10A is a left side view of a bendable thin sheet-shaped plate according to Embodiment 7 of the present disclosure.
Figure 10B:
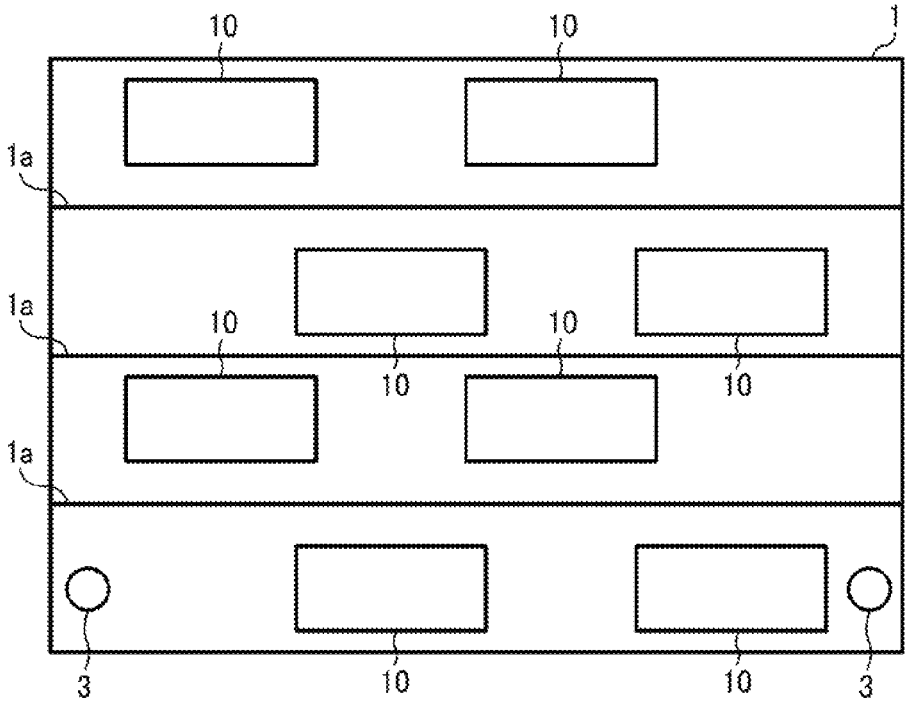
FIG. 10B is a front view of the sheet-shaped plate of FIG. 10A.

FIGS. 10A and 10B are views of Embodiment 7, which correspond to FIGS. 5A and 5B, respectively. Embodiment 2 has explained, as an example, the array of one color, in which a row of the heads in the staggered arrangement is mounted on each of the two different inclined surfaces, but as illustrated in FIGS. 10A and 10B, a row of the heads in the staggered arrangement may be mounted on each of four different inclined surfaces in arrays, in which two colors are combined in pair. In this case, three bends 1*a* are provided, and reference holes 3 are provided on one side of the sheet-shaped plate 1 with respect to one of the bends 1*a* which is positioned on an end side of the sheet-shaped plate 1, as illustrated. Incidentally, the present disclosure can also adopt a configuration in which six different inclined surfaces are provided for three colors of heads, or a configuration in which eight different inclined surfaces are provided for four colors of heads. Also, the reference holes 3 may be provided to be arranged at diagonal positions of the sheet-shaped plate 1 as Embodiment 5, and may be provided to be arranged at line-symmetrical positions along a shorter end of the sheet-shaped plate 1 as Embodiment 6.

As described above, according to at least one embodiment of the present disclosure, a line head array structured by arranging a plurality of heads in a staggered manner, in particular, a line head array, in which a recording medium is conveyed by a drum; heads are arranged radially to a drum center; nozzle faces of the respective heads are not on the same plane, and all of the heads cannot be subjected to optical adjustment at the same time, can be constructed with high accuracy.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A head array comprising:

an array base having a plurality of inclined surfaces;

a bendable sheet-shaped plate member having a bend and disposed on each of the plurality of inclined surfaces of the array base; and a plurality of heads disposed on both sides, relative to the bend, of the sheet-shaped plate member, wherein the sheet-shaped plate member bent at the bend is disposed on, and secured to the array base in parallel to each of the plurality of inclined surfaces of the array base.

2. The head array according to claim 1, further comprising:

a positioning reference hole formed in the sheet-shaped plate member; and a positioning reference pin on the array base at a position corresponding to the positioning reference hole.

3. The head array according to claim 1, further comprising:

a plurality of positioning reference holes formed at both sides of the sheet-shaped plate member, relative to the bend; and a plurality of positioning reference pins on the array base at positions corresponding to the positioning reference holes.

4. The head array according to claim 3, wherein the positioning reference holes are formed at diagonal positions of the sheet-shaped plate member.

5. The head array according to claim 3, wherein the positioning reference holes are formed at line-symmetrical positions with respect to the bend.

6. The head array according to claim 1, wherein the sheet-shaped plate member has at least another bend.

7. The head array according to claim 1, further comprising a recessed groove on the bend of the sheet-shaped plate member.

8. The head array according to claim 1, further comprising a plurality of openings on the bend of the sheet-shaped plate member.

9. The head array according to claim 1, further comprising a retainer having respective inclined surfaces parallel to the inclined surfaces of the array base, to press the sheet-shaped plate member to the array base to secure the sheet-shaped plate member to the array base.

10. An image forming apparatus comprising:

the head array according to claim 1; and a conveyor to convey a recording medium.

* * * * *